United States Patent [19]

Schwarz et al.

[11] 4,171,274

[45] Oct. 16, 1979

[54] ALTERATION OF TESSELATED MAGNETIC PARTICLES BY FRACTURE

[75] Inventors: William M. Schwarz; Robert S. Karz; Peter F. Erhardt, all of Webster; Charles G. Dickerson, Farmington, all of N.Y.

[73] Assignee: Xerox Corporation, Stamford, Conn.

[21] Appl. No.: 813,602

[22] Filed: Jul. 7, 1977

[51] Int. Cl.[2] ..... G03G 9/08

[52] U.S. Cl. ..... 252/62.1 P; 96/1 SD

[58] Field of Search ..... 96/1 SD; 252/62.1

[56] References Cited

U.S. PATENT DOCUMENTS

| | | | |
|---|---|---|---|
| 2,846,333 | 8/1958 | Wilson | 252/62.1 |
| 3,655,374 | 4/1972 | Palermiti | 252/62.1 |
| 3,790,407 | 2/1974 | Merten et al. | 428/148 |
| 3,839,029 | 10/1974 | Berg et al. | 252/62.1 |
| 3,898,170 | 8/1975 | Kasper | 252/62.1 |
| 3,900,587 | 8/1975 | Lenhard et al. | 252/62.1 |
| 3,914,181 | 10/1975 | Berg et al. | 96/1 SD |

*Primary Examiner*—Roland E. Martin, Jr.
*Assistant Examiner*—John L. Goodrow

[57] ABSTRACT

A process of modification of magnetic toner for use in electrostatic development processes involving a magnetic toner without carrier is disclosed. The modified toner of the invention is effectively fused at lower temperatures. The toners of the invention are modified such that small portions of the surface are removed.

7 Claims, 4 Drawing Figures

ALTERATION OF TESSELATED MAGNETIC PARTICLES BY FRACTURE

BACKGROUND OF THE INVENTION

This invention relates to electrophotographic development utilizing magnetic toner particles which are applied from magnetic brush to the electrostatic latent image without use of a carrier material.

There have been suggested systems for magnetic development not utilizing the carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

Another process utilizing magnetic toner involves the development with a magnetic toner of magnetic images carried on a surface such as magnetic tape. Such a process is illustrated in U.S. Pat. No. 3,804,511. One drawback of such a process is that the heavily, about 65 percent by weight loading magnetite of the toner particles results in a toner image which is difficult to fuse particularly at a high rate or at normal fusing temperatures.

A further development of magnetic development without carriers is illustrated by Kotz, U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers from the disadvantage that it does not transfer well from a photoconductive substrate to plain bond paper.

A method of forming toners that are field dependent such that they will develop conductively and transfer electrostatically has been invented and described in copending patent application Ser. No. 792,636, now abandoned entitled "Single Component Magnetic Toner", which is hereby incorporated by reference. This technique provides excellent development and transfer characteristics. However, the toner is formed by the spray drying techniques that result in magnetite concentrated at the surface of the toner giving higher fuse temperatures than are preferable to utilize present roll fusing techniques.

Therefore there is a continuing need for toners suitable for use in one component magnetic development systems. Further there is a need for toners suitable for high speed development and the resultant high speed fusing to plain paper. There is further need for toners which will flow well and transfer effectively. There is a continuing need to lower fusing roll temperatures to conserve energy and lower cost.

SUMMARY OF THE INVENTION

It is an object of this invention to provide a toner overcoming the above noted deficiencies.

It is a further object of this invention to provide a process of toner manufacture that overcomes the deficiencies of the above noted processes.

It is another object to produce clear sharp images by magnetic brush development of electrostatic images without using a carrier.

It is a further object to produce a toner that will fuse rapidly at a lower temperature.

It is a further object to improve transfer efficiency of magnetic toners.

It is an additional object to provide toner having improved flow characteristics.

It is another additional object to form a toner suitable for high speed development by magnetic brush system without carrier.

It is a still further object to produce a toner of improved fusing for development of electrostatic images.

It is still an additional object of this invention to form an easily fused electrically field dependent toner by a simple process.

It is another object to form toners such that after transfer to paper the remaining toner may easily be cleaned from the photoreceptor.

These and other objects of the invention are generally accomplished by subjecting a spray dryed magnetic toner to an attrition process which removes a small portion of the surface to expose the underlying inner portion. The spray dryed magnetic toners have a high concentration of magnetic pigment on the surface and the chipping treatment exposes portions of the inner portion of the particle that have a low magnetic pigment concentration. The attrition is generally of such a nature that the field dependent properties of the toner are not significantly changed and a particle size decrease is not significant so as to necessarily be measurable by ordinary Coulter Counter analysis. The slight attrition results in a lowering of minimum fuse temperature by at least about 10° F. The preferred method of attrition is the use of a fluid energy mill.

In a preferred embodiment of the invention the toner is a field dependent magnetic toner wherein the toner particles comprise a resin and coated magnetic particles concentrated at the surface to the toner particles. The coated magnetic particles generally comprise magnetite coated with a thin coating of surfactant material compatible with the resin of the toner but also compatible with the solvents utilized in the spray drying of the toner.

The instant invention also lowers the minimum fuse temperature of non-field dependent magnetic toners used for imaging processes not requiring electrostatic transfer. These processes include those involving imaging onto a magnetic belt and also those involving imaging and fusing onto ZnO paper.

DESCRIPTION OF THE INVENTION

The instant invention relates to treatment of spray dried magnetic toners, in the preferred embodiment field dependent toners, wherein the treatment has the effect of lowering the fusing temperature of the toner particles without significant adverse effects to other properties such as the field dependent properties or magnetic properties of the toner. The effect of the treatment of the invention is to remove some of the surface of the toner particles. The toner particles of the instant invention as recovered after spray drying are generally rounded and have a concentration of magnetite at the surface resulting in a mottled or tesselated surface. This concentration of magnetite or other magnetic particles at the surface has the effect of making the particle more difficult to fuse than if evenly distributed within the particle. It is theorized that the heavy loading of solid particles at the surface has a "cheese ball" effect. This cheese ball effect results in a strengthened surface whereby although a toner of the polymer ordinarily would be flowable at a certain temperature the strengthening effect of the solid surface particles results in a higher temperature of fusing necessary in order for the toner particle to flow and be adequately fused to the paper surface. It is theorized that removal of portions of the surface weakens the structure of the particles thereby allowing flow at lower temperatures. The amount of surface removed in accordance with the instant invention is not easily detectable by particle measurement devices. For instance the amount of treatment is not beyond the normal range of error for a Model T Coulter Counter. The invention generally requires an amount of attrition which results in a lowering of the fuse temperature by greater than 10° F. while not so much as to cause field dependent particles to become insulating at high fields. Minimum fuse temperature is defined for purposes of this specification as the minimum fuser roll temperature on nip entrance that gives acceptable fix of toner to paper as measured by the loss of less than 20% of optical density after 10 cycles on a Model 503 Taber Abraser manufactured by the Teledyne Company. The two wheels of the Taber Abraser are CS-10 loaded to 1000 gm load weight. The CS-10 wheels are cleaned with sand paper between cycles. A cycle is one revolution of the card passing underneath the abraser wheels.

Figure 1:
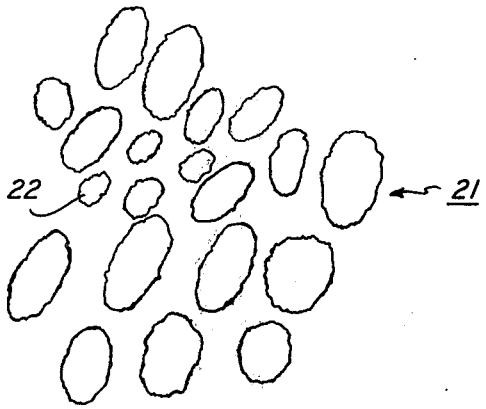
FIG. 1 illustrates untreated toner in cross-section.
Figure 2:
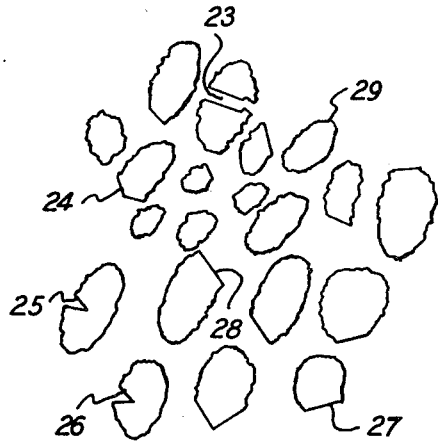
FIG. 2 illustrates the toner of FIG. 1 after treatment.

The effect of the treatment of the invention on toner particles is illustrated by reference to FIGS. 1 and 2. In FIG. 1 represented generally by 21 is an illustration of toner particles prior to treatment. The toner particles as illustrated have a mottled, rough or tessalated surface caused by the concentration of magnetite or other magnetic particles at the surface during spray drying. The tone prior to treatment is formed of generally rounded oval and spherical shaped particles. The toner generally varies in size between about 5 and about 20 microns. The particles produced by spray drying are generally rounded although not necessarily spherical. There are some fines as illustrated by particle 22 although generally the particles are of fairly uniform size. The same particles after treatment are represented by FIG. 2. The toner after treatment as illustrated in FIG. 2 now contains some split particles such as 23. Further there are other particles that have had wedge shaped pieces fractured from them such as at 25 and 26. Further there are many particles that have received a flatened portion where the surface is removed such as 24, 27 and 28. Some particles such as 29 are unaltered by the attrition of the mass of toner. As can be seen by FIGS. 1 and 2 the change in the toner particles is minor therefore leading to very little decrease in their field dependent properties. A greater amount of treatment exposes so much of the inner portion as to lead to insulating non-field dependent particles.

Figure 3:
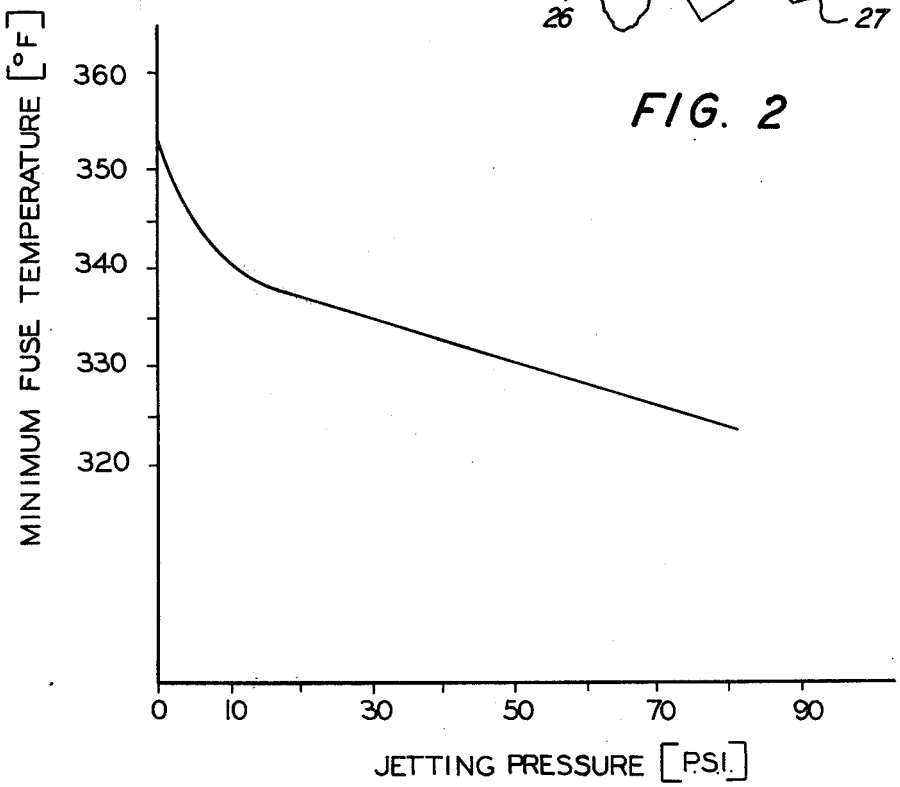
FIG. 3 illustrates the lowering fuse temperature by the treatment of the instant invention.

FIG. 3 represents the typical decrease in minimum fuser temperature which results from the mild fluid energy treatment of a toner. As can be seen the treatment of between about 10 and about 70 psi leads to the significant decrease in minimum fuse temperature of from about 350° F. to about 325° F. As above pointed out this remarkable increase in fusing performance is achieved without substantial change in other toner properties such as magnetism and field dependence. If the jetting treatment is carried out to great extent the field dependent toner becomes insulating and loses its field dependence. The treatment of the invention may be defined in the instance of field dependent toners as attrition to a point which does not allow the properties to fall outside of the field dependent range defined below. In other words the initial resistivity is greater than $10^{12}$ ohm-cm and as the applied field is increased the resistivity drops sharply at a slope greater than 5 when plotted as the log of resistivity in ohm-cm versus the log of field in volt/cm. The non-field dependent and field dependent magnetic toners that are attrited in accordance with the invention have a minimum fuse temperature decrease of at least 10° F. The particles of the toners of the invention generally have an average size of about 5 to about 30 microns. This average size is not significantly changed by the treatment process.

Figure 4:
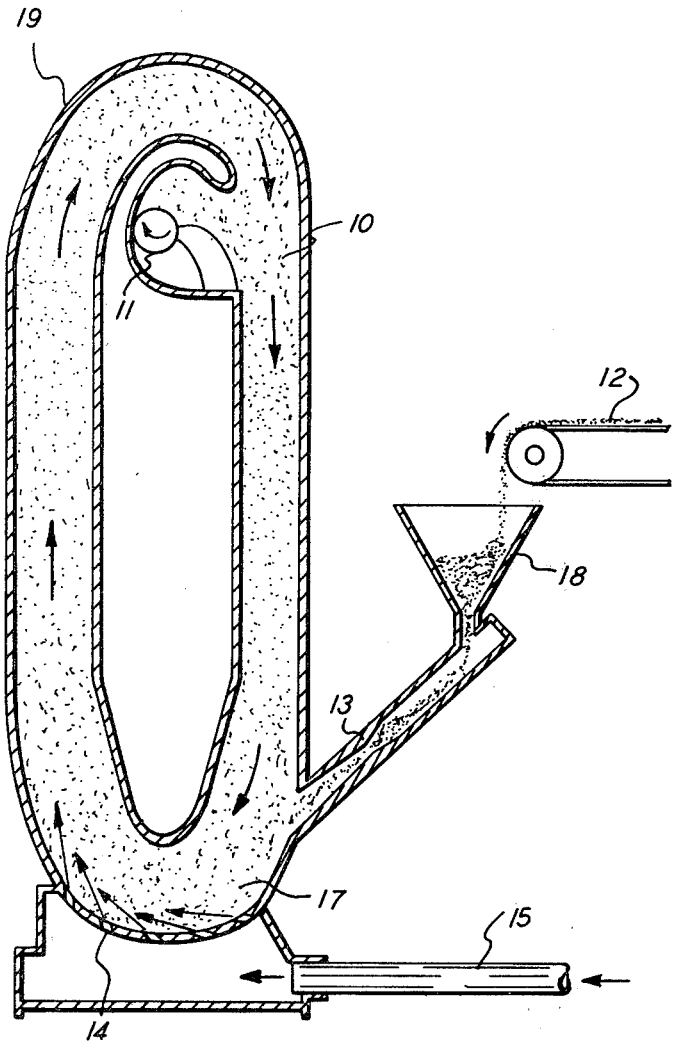
FIG. 4 illustrates a fluid energy mill such as may be utilized in the treatment of toner of the instant invention.

FIG. 4 illustrates a fluid energy mill such as is suitable for the attrition of the invention. In the instant invention the field energy mill is operated by insertion of toner material 12 into hopper 18 from which it enters by way of venturi nozzle 13 into the grinding chamber 17 where air which is injected at 15 is introduced in the chamber through nozzles 14. The air entering the chamber through nozzles 14 entrains the material in the rapidly circulating turbulent flow where it is pulverized by mutual impaction and attrition. The material proceeds around the mill to the classifier 10 where spent air exits through port 11 taking with it the attrited material which has reached a point that it is light enough to be entrained in the exit stream. Large particles remain entrained and proceed again to the grinding chamber. When a device such as 19 is operated in accordance with the instant invention the feed is fed as fast as possible while the air pressure is set at a very low setting such as about 10 psi to about 150 psi. This flood condition of feed combined with low air pressure gives very little turbulence and a very small amount of grinding and attrition takes place. Low air pressure reduces velocity and centrifugal force on particles which results in quick exit through port 11. Quick exit results in a low amount of attrition.

Any type of attrition device may be utilized in the instant invention that results in lowered minimum fuse temperature without harmful effect to other properties. Generally fluid energy mills such as microizers are suitable. The preferred method is jetting of the spray dried toner at low pressure and high feed rate as this allows rapid chipping treatment of a large quantity of material at low cost.

In a specific embodiment of a field dependent toner in accordance with the instant invention a stearic acid is neutralized with ammonium hydroxide to form a water soluble ammonium compound. Magnetite pigment is added to the aqueous solution with agitation such that the ammonium compound is deposited on the pigment surface and then decomposed and converted back to the stearic acid by heating. The material is filtered, washed and dried and the pigment is then dispersed in a solution of toluene and styrene-butylmethacrylate resin and spray dried. The magnetite may be used in an amount of about 50 percent by weight of the resin magnetite dispersion. The solvent forms about three forths by weight of the total spray drying slurry. Magnetite coated by other methods is also suitable for the instant process. The material after recovery from spray drying is treated in a Model 0202 Jet-O-Mizer at a pressure of about 50 psi and a flood feed condition of about 180 lbs per hour.

The preferred toners of the instant invention generally have resistivity that is dependent on the strength of the electrical field. They are conductive during the high field development but have a powder resistivity of about $10^{12}$ to $10^{17}$ ohm-cm at the low field. Because of high resistivity at low field the toners retain sufficient charge to transfer effectively. The great field dependent resistivity change of these toners allows transfer of the toner by the customary electrostatic transfer processes without use of specially treated paper or transfer techniques such as pressure or use of adhesives. Further the toner is conductive at high fields so as to easily develop by inductive techniques. The toners of the instant invention have a resistivity of greater than about $10^{12}$ ohm-cm at low fields of about 10 volt/cm. It is preferred that the high resistivity of greater than about $10^{12}$ ohm-cm be maintained at at least up to about 100 volt/cm field strength to give greater transfer latitude. The preferred initial resistivity is greater than $10^{14}$ ohm-cm as this range allows good transfer of the electrostatic image. The toners of the invention display a substantially stable resistivity as field strength increases and then have a sharp break point where the resistivity rapidly decreases at a slope greater than about 5 when plotted as the log of powder resistivity (ohm-cm) versus log of the field in volt/cm. The preferred slope is greater than about 10. Generally the slope is about 10 to 20 for field dependent toners of the instant invention. The slope greater than about 10 is preferred as it results in excellent electrostatic transfer and also good development.

The invention also may be practiced with non-field dependent toners. These toners are formed in a manner such as above only without coating of the magnetic pigment prior to slurry formation and spray drying. The slight attrition treatment of the invention has the effect of lowering their fuse temperature by greater than about 10° F.

The toners and magnetic pigments therein of the instant invention are referred to as magnetic because they are attracted to a magnet. The toners are held to a magnetic toner brush roller or belt by magnetic forces. The magnetic toner brush is biased to induce a charge, opposite to that carried by the photoreceptor, into the toner particles. Then the outer particles develop the electrostatic image as the electrostatic forces overcome the magnetic forces to deposit toner in the image areas. The earlier referenced U.S. Pat. No. 3,909,258 has illustrations of the forces present in the developing process utilizing a magnetic toner brush system without a carrier.

The magnetic pigment utilized in the toners of the invention may be any suitable particle which will give the desired magnetic properties. Typical of such materials are ferrites, iron particles and nickel alloys. Preferred for the instant process are magnetite particles as they are black in color, low cost and provide excellent magnetic properties. The magnetite particles may be any shape and any size which results in a semiconductive toner particles with good transfer properties. Generaly the particle size is between 0.02 micron and about 1 micron. A preferred average particle size for the magnetite particles is about 0.1 to 0.5 micron average particle size. The particles may be any shape including acicular or cubic shaped.

The transfer efficiency of the field dependent toners of the instant invention is greater than about 70 percent and often reaches 85 percent or above in ordinary electrostatic transfer from selenium photoreceptors.

The coated magnetic pigment may be utilized in any amount that forms a magnetic field dependent toner. A suitable range for field dependent toners has been found to be a magnetic pigment content between about 20 and about 70 weight percent of coated magnetic particle in the finished toner. A preferred range is a coated magnetite content between about 45 and 55 weight percent of coated magnetite for good magnetic development properties and good transfer.

For toners that are non-field dependent the loading of magnetic pigment may be any amount that developes well on treated ZnO paper or developes and transfers well from a magnetic belt if that method of imaging is utilized. Generally ranges between about 20 and 75 weight percent magnetite in the toner are suitable. The preferred range for good quality dense imaging on magnetic substrates is a magnetite content of about 60–75 percent by weight magnetite to toner. The preferred for magnetite content for developing and fixing on zinc oxide paper is 45 to 55 weight percent of the toner for good development and fusing.

The material coating the magnetic particle in field dependent toners may be any material which is compatible with the toner resin and maintains a firm bond to the magnetic particle during mixing with a solvent for the toner resin and spray drying. These materials generally are surfactants. The magnetic particle coating suitably has one moiety displaying affinity to the magnetite surface such as carboxylic, sulfate, sulfonate, phosphate, ester, alcohol, amine, amide groups and quarternary ammonium compounds, or combination of the above and another moiety which displays affinity to the resin and the solvent such as long chain aliphatic groups comprising from 6 to 22 carbon atoms or aromatic groups of about the same carbon content. Preferred are stearic acid and stearic acid derivative materials which have been found to have good dispersion properties and result in desirable semiconductive toner properties that aid in transfer. The amount of coating typically may vary between about 0.1 and 10 percent by weight. A preferred range of coating material for magnetite is about 1 to about 5 weight percent of the magnetite for good insulative properties at low field.

The toner resins may be selected from any suitable toner resin material that is compatible with the coating of the magnetite.

Any suitable resin possessing the properties as above described may be employed in the system of the present invention. Typical of such resins are polyamides, polyurethanes, epoxy, vinyl resins and polymeric esterification products of a dicarboxylic acid and a diol comprising a diphenol. Any suitable vinyl resins may be employed in the toners of the present system including homopolymers or copolymers of two or more vinyl monomers. Typical of such vinyl monomeric units include: styrene; p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbozole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polurethane resins, cellulosic resins, polyether resins and mixtures thereof.

Polyermic esterification products of a dicarboxylic acid and a diol comprising a diphenol may also be used as a preferred resin material for the toner compositions of the instant invention. The diphenol reactant has the general formula:

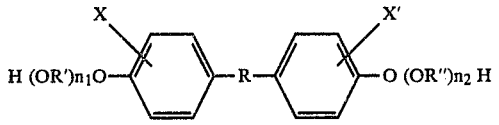

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis (4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis (4-hydroxy-propoxy-phenyl)-propane, 2,2-bis(4-hydroxy-propoxy-phenyl)propane, 1,1-bis(4-hydroxy-ethoxy-phenyl)-butane, 1,1-bis (4-hydroxy isopropoxy-phenyl)heptane, 2,2-bis(3-methyl-4-beta-hydroxy ethoxy-phenyl)propane, 1,1-bis(4-beta hydroxy ethoxy phenyl)-cyclohexane, 2,2'-bis(4-beta hydroxy ethoxy phenyl)norbornane, 2,2'-bis(4-beta hydroxy ethoxy phenyl)norbornane, 2,2-bis(4-beta hydroxy styryl oxy-phenyl)propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n3}\ COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resins modified phenol-formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re. 25,136 to Carlson and polystyrene blends as described in U.S. Pat. No. 2,788,288 to Rheinfrank and Jones.

Any method of toner particle formation may be utilized in the instant invention which results in toner of the desired properties having magnetite pigment at the surface. Typical of conventional methods of toner formation are hot melt formation and mastication followed by attrition to toner particle size. The preferred method of the instant invention is forming a solvent dispersion of the magnetite and toner resin and spray drying the dispersion of the magnetite and toner resin as this results in toner particles having the magnetite concentrated at the surface and results in toner of good magnetic and electrostatic properties for excellent magnetic induction development and for field dependent toners good electrostatic transfer to plain paper. While not wishing to be bound by any theory as to why the instant toners display their remarkable field dependent properties it is believed that the properties are somehow related to the concentration of magnetic particles at the surface of the toner and that the coating of the magnetic pigment contributes to this higher concentration that results after spray drying. The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer resins and styrene polymer blends as this results in a toner that is essentially solvent free and the solvent is low cost and relatively non-toxic. Chlorofrom has been found to be a preferred solvent for use with polyester type toner resins as it is readily available, nonflammable and results in a toner of low residual solvent. Both chloroform and toluene also are compatible with the preferred fatty acid and derivative coatings for the magnetite. The solvent is generally used in an amount such that the solids content of the solvent slurry is 5–20% by weight. The term solids content is used here to indicate the solid resulting from spray drying which is the resin and magnetite plus any other additives to the toner such as colorants.

A method of formation of magnetite coated in a manner particularly suitable for use in the instant forming field dependent toners is set forth below. Magnetite coated by the process is not humidity sensitive which is an advantage in toner formation and further readily is dispersed in solvents and resins without effecting the properties of the coating. This process is generally performed by neutralizing a fatty acid such as stearic acid or a derivative of a fatty acid with ammonium hydroxide to form a water soluble ammonium compound. The pigment preferably magnetite, is then added to the aqueous solution with agitation. Ammonium compound is deposited on the pigment surface and then decomposed and converted back to the fatty acid or derivative of a fatty acid by heating. The aqueous dispersion is then filtered, washed and dryed. The pigment coated by this process is hydrophobic and has good dispersion properties in organic matrixes such as polymer resins and organic solvents. Among suitable fatty acids and fatty acid derivatives are myristic, pentadecanoic, palmitic, lauric, margaric, oleic and linoleic acids and mixtures thereof. Preferred are stearic acids and mixtures of stearic acid and other fatty acids of $C_{14}$ to $C_{18}$ to give good coating and electrical properties.

Another method of forming field dependent toners involves in situ coating with a fatty acid then spray drying. This toner forming method involves generally spray drying a dispersion of a resin and magnetite coated with a fatty acid such as stearic acid or a derivative of a fatty acid to form a toner. The dispersion of magnetite and fatty acid in solvent generally is agitated or heated with reflux and agitation for a time prior to addition of polymer and spray drying. In a specific embodiment fifty parts by weight magnetite, 2 parts by weight stearic acid and 50 parts of toluene were mixed and heated to about 110° C. for about 1 hour with reflux and agitation. After heating the mixture is blended with a polymer solution containing a styrene polymer in toluene. The dispersion was then spray dryed to form a toner. The toner is found to have a powder resistivity from $10^6$ ohm-cm to $10^{17}$ ohm-cm depending on field strength.

The agitation or agitation with heating of the magnetite and fatty acid or fatty acid derivative in solvent may be carried out for any length of time resulting in a toner having the desired field dependent properties after spray drying. Generally the heating is carried out with reflux for a period of about 30 minutes to 3 hours. A preferred time of heating is about 1 hour with reflux which results in a toner having the desired field dependence without an overly long formation time period. A temperature of reflux heating is selected dependent on the volatility of the solvent being used. The heating temperature of about 100° to about 150° C. has been found to be typical for common solvents.

Other methods of coating the stearic acid or stearic acid derivatives onto magnetite particles may also be utilized. Among these processes are the direct coating onto magnetite particles by tumbling with a fatty acid material possibly with low heat. Another method of coating magnetite is to coat it with an ammonium stearate or other fatty acid ammonium salt and then heat the coated particle so that the fatty acid coated particle is recovered.

While the above discussion has not included the addition of additives to the solvent prior to spray drying for inclusion in the toner it is encompassed in the invention that additives such as pigments, humidity control materials and dyes may be added prior to toner formation. The preferred magnetite materials are black and therefore suitable for the majority of electrophotographic reproduction uses without benefit of colorant additives. However other less dark colored magnetic materials might require pigment of dye additives to obtain a suitable toner color.

The above discussion has dealt primarily with the preferred field dependent toners that transfer electrostatically after carrierless magnetic development. The invention is also applicable to non-field dependent toners used for development and fusing on ZnO paper and to magnetic toners used for development of magnetic images such as in U.S. Pat. No. 3,804,511. These toners when spray dried also have magnetic particles concentrated on the surface. The instant process lowers these fusing temperatures just as does the field dependent toner.

It is further contemplated that after treatment processes such as classification might be necessary depending on the particle size range achieved by the spray drying.

DESCRIPTION OF THE PREFERRED EMBODIMENTS

The following Examples further define, describe and compare methods of preparing toners of the instant invention and of utilizing them in electrophotographic applications. Parts and percentages are by weight unless otherwise indicated.

EXAMPLE I

About 100 grams of 65/35 styrene-butylmethacrylate resin is dissolved in about 800 grams toluene. After dissolving the resin with toluene 100 grams Pfizer MO 4431 coated magnetite is added to a Kady mill containing the solution and is milled for 30 minutes. The Pfizer coated magnetite comprises acicular particles of about 0.1 to about 1 micron length and 0.02 to 0.2 micron diameter. They are coated with stearate coating comprising a mixture of fatty acids and calcium salts. The calcium salts are believed to be hydrophilic resulting in a slightly humidity sensitive property. After milling the dispersion is fed to a Bowen spray dryer at a feed rate of 200 milliliters per minute and at an air temperature of 180°-220° F. Toner particles having an average size of about 15 microns and a range of from about 5 to about 30 microns are recovered.

After recovery the toner particles are fed to a model 0202 Jet-O-Mizer manufactured by Fluid Energy Incorporated, Hatfield, Pennsylvania, at flood feed condition of about 180 lbs per hour and a pressure of about 50 psi. The comparison of particles size utilizing a Coulter Counter Model T did not indicate any measurable difference in particle size after treatment. The toner however had a reduction of about 25° F. in the minimum fuse temperature when compared with the toner prior to fluid energy mill treatment. The device utilized to test the fuser latitude consisted of a conformable silicone rubber coated fuser roll lubricated with silicone oil and internally heated. The transfer and development properties of the toner were not adversely effected by the treatment in the fluid energy mill.

EXAMPLE II

The process of Example I is repeated except the fluid energy mill pressure is set at about 10 psi. This results in a toner decrease in minimum fuse temperature of about 10° F. when compared with untreated toner.

EXAMPLE III

The process of Example I is repeated except a pressure of about 90 psi is utilized in the fluid energy mill. This results in a decrease in minimum fuse temperature from untreated toner of about 30° F.

EXAMPLE IV

The process of Example I is repeated except 96 grams of Piccolastic D-125 a polystyrene polymer is substituted for the polymer and 104 grams of coated magnetite is utilized. The properties are similar to the Example I toner except it is more humidity sensitive.

EXAMPLE V

The process of Example I is repeated except that chloroform is substituted for the toluene and 100 grams of polyester resin is substituted for the resin of Example I. This toner also exhibits good electrical characteristics and transfers very well. The fuse temperature change is similar to the Example I toner.

EXAMPLE VI

The process of Example I is repeated except 140 grams of the uncoated magnetite Pfizer 4232 are utilized and 60 grams of the resin are utilized. The toner of this Example is developed by a magnetic system onto a magnetic belt and exhibits minimum fuse decrease of about 20° F. compared with untreated toner.

EXAMPLE VII

The process of Example I is again repeated except 130 grams of the coated magnetite is utilized and 70 grams of the resin. The toner also exhibits good transfer and development characteristics. The minimum fuse improvement is similar to the Example I toner.

EXAMPLE VIII

About 130 grams of Pfizer MO 4431 Magnetite, about 70 grams of Emerez 1552 Emery Industries polyamide and 800 grams of chloroform are formed into a dispersion. This dispersion is spray dried in a Bowen 5 foot spray dryer at about 180° F. temperature, 1000 ml/min feed rate and air flow of about 1100 scfm. Chipping or attrition of the particles is carried out by flood feed to a Model 0202 Jet-O-Mizer. The toner is utilized to form an image on a magnetic belt and is transferred to plain paper. Prior to chipping the toner does not fix sufficiently with a silicone lubricated conformable roll fuser to withstand 10 cycles of Taber abrasion. After chipping fusing is possible and Taber cycles are more than ×25. This Example illustrates that a fusible toner may be formed from particles that until treatment could not be adequately fused in a particular system.

The resistivity measurements for toner used throughout this application are determined by the following process. Measurements on powder are complicated by the fact that the results are influenced by characteristics of the powder particles shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volume is reached. The current is measured as a function of applied voltage at the 50 mil gap. The electrification time is 1 minute as recommended by ASTM method. After each measurement the sample is repacked by vibration. Resistivity is calculated according to Ohms law.

The transfer efficiency in this application is measured comparing the weight of toner transferred to a paper with the weight of toner remaining on the photoreceptor and removed by an adhesive tape applied thereto after transfer to paper is completed.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used by the toner of the present invention other steps or modifications may be used. For instance the toner could be classified prior to utilization for developing and transfer. In addition other materials such as colorants could be added.

Other modifications of the present invention will occur to those skilled in the art upon reading the present disclosure. These are intended to be included within the scope of this invention. For instance, the magnetic toner including the field dependent toners of this invention could be utilized in conventional magnetic development onto zinc oxide paper where transfer did not take place. Further the toner of this invention could be utilized for processes requiring development of magnetic images rather than electrostatic latent images.

What is claimed is:

1. A carrierless developer consisting essentially of toner particles, the toner particles comprising resin and magnetic particles wherein the magnetic particles are concentrated at the surface of the toner particles, the surface being altered to remove small amounts thereof to expose the inner portion of said toner particles, the altered particles having a minimum fuse temperature greater than 10° F. below the fuse temperature of the unaltered particles.

2. The carrierless developer of claim 1 wherein said magnetic particles comprise magnetite.

3. The carrierless developer of claim 1 wherein the small amount of surface removed corresponds to the action of a fluid energy mill operating at between about 10 and about 150 psi with a flood feed condition.

4. The carrierless developer of claim 1 wherein said toner particles are generally rounded.

5. A carrierless developer consisting essentially of toner particles, the particles comprising resin, and a surfactant coated magnetite wherein the surfactant coating comprises a fatty acid or fatty acid derivative and the toner particles are characterized by a field dependence such that at fields less than 100 volt/cm the resistivity is greater than $10^{12}$ ohm-cm and at fields higher than 100 ohm-cm the resistivity is less than $10^{12}$ ohm-cm and by a small amount of surface removed from the particles to expose the interior of the particle the particles having a minimum fuse temperature greater than 10° F. below the fuse temperature of the untreated particles.

6. The carrierless developer of claim 5 wherein said small amount of surface removed corresponds to the action of a fluid energy mill operating at between 10 and 150 psi with a flood feed condition.

7. The carrierless developer of claim 6 wherein said toner particles are generally rounded.

* * * * *